US005509159A

United States Patent [19]

Du-Bois

[11] Patent Number: 5,509,159

[45] Date of Patent: Apr. 23, 1996

[54] UNDERCARRIAGE

[75] Inventor: Robert L. Du-Bois, Goulburn, Australia

[73] Assignee: Ferno Washington, Inc., Wilmington, Ohio

[21] Appl. No.: 296,813

[22] Filed: Sep. 2, 1994

Related U.S. Application Data

[63] Continuation of PCT/AUG94/00005, Jan. 4, 1994.

[30] Foreign Application Priority Data

Jan. 4, 1993 [AU] Australia ..... PL6644

[51] Int. Cl.[6] ..... A47B 1/00

[52] U.S. Cl. ..... 5/627; 5/611; 296/20

[58] Field of Search ..... 5/627, 86.1, 611; 296/20; 248/188.6

[56] References Cited

U.S. PATENT DOCUMENTS

| | | | |
|---|---|---|---|
| 2,339,075 | 1/1944 | Hollnager | 5/611 |
| 2,523,076 | 9/1950 | Sweetland | 5/611 |
| 2,692,169 | 10/1954 | Phillips | 5/611 |
| 2,872,688 | 2/1959 | Reichert et al. | 5/611 |
| 3,039,118 | 6/1962 | Hutt | 5/611 |
| 3,462,772 | 8/1969 | Morrison | 5/611 |
| 3,826,528 | 7/1974 | East | 296/20 |
| 3,917,076 | 11/1975 | Campbell . | |
| 3,980,334 | 9/1976 | Ferneau et al. | 5/86.1 |
| 4,170,379 | 10/1979 | Eicher | 296/20 |
| 4,767,148 | 8/1988 | Ferneau et al. | 5/611 |

FOREIGN PATENT DOCUMENTS

| | | |
|---|---|---|
| 64629/90 | 4/1991 | Australia . |
| WO88/01857 | 3/1988 | WIPO . |

*Primary Examiner*—Michael J. Milano
*Attorney, Agent, or Firm*—Killworth, Gottman, Hagan & Schaeff

[57] ABSTRACT

An undercarriage, particularly for stretchers, which has multi-height adjustment and does not need to be manually raised or lowered by the attendant when being loaded into, or unloaded from, an ambulance. The undercarriage includes a rectangular support structure, a wheeled height adjustable framework having first and second pairs of collapsible legs, and a height actuating mechanism. The height actuating mechanism comprises one or more ties connected to the first and second pairs of legs and to the support structure which are retractable or extendable so as to extend or collapse the first and second pairs of legs to thereby adjust the height of the support structure.

9 Claims, 6 Drawing Sheets

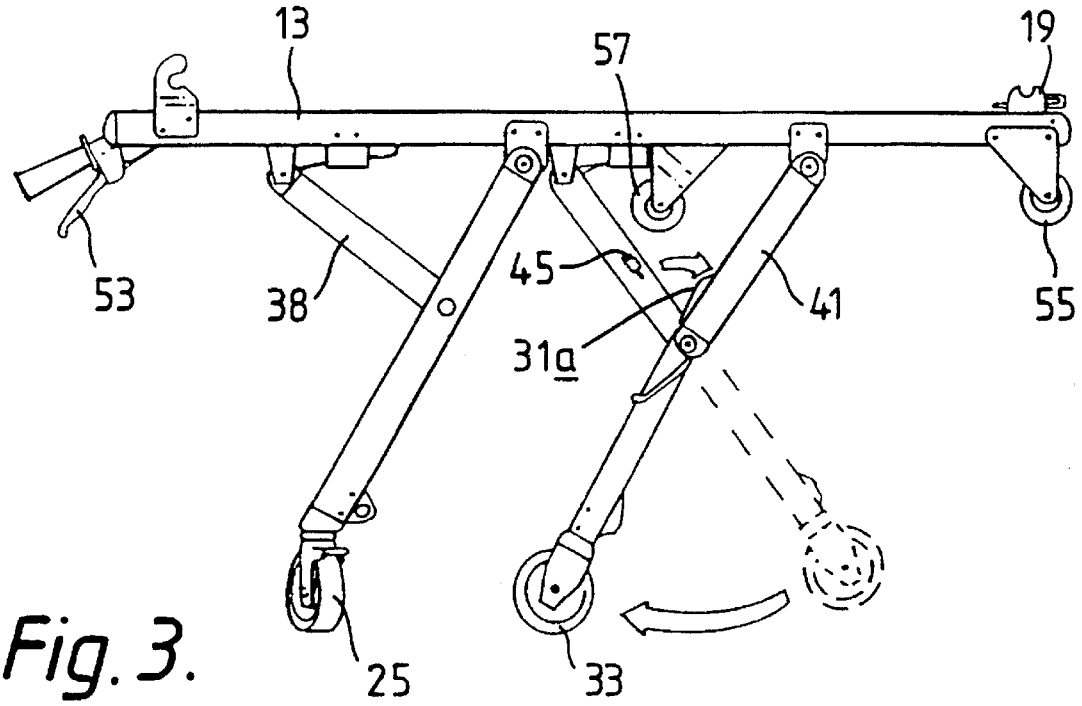
Fig. 3.
Fig. 4.
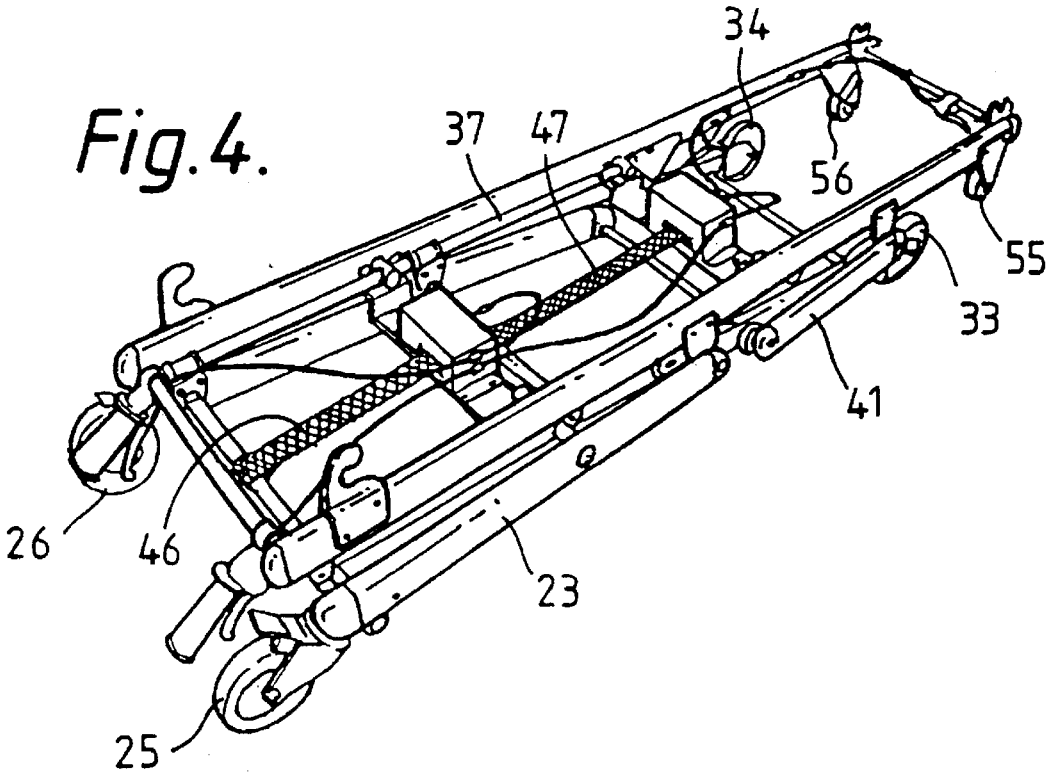

UNDERCARRIAGE

Continuation of PCT/AUG94/00005, Jan. 4, 1994.

TECHNICAL FIELD

This invention relates to equipment for transporting people, animals, goods and materials, and other such objects, and is particularly concerned with a height adjustable wheeled undercarriage to which a stretcher, pallet, or like platform can be fitted. The invention has been primarily devised for the purpose of transporting patients and will therefore be described in this context, however its broader ramifications for use as a general transport undercarriage should be borne in mind and the following description is not to be taken as limiting the scope of the invention in any manner whatsoever.

BACKGROUND ART

Patient transporting equipment such as ambulance cots, are available in a wide range of designs and models. Most, however are not adjustable in height and those that are are restricted to a specific number of heights to which they can be set. The setting of such heights usually involves a series of operations involving manipulating pins and/or levers, and is time consuming and, in many cases, awkward.

A further disadvantage of existing ambulance cots is that they are not readily adaptable to loading into different makes or models of ambulances which vary from one to another in the heights of their loading platforms. To accommodate differing heights, the cot must usually either be tilted or, if adaptable to a range of specific heights, must be readjusted in height with locating pins to correspond with the particular height of the ambulance. More often than not, such height adjustment cannot be sufficiently fine tuned with the result that the cot must still be tilted to some degree to enable loading. Such operations are not only time consuming and inconvenient to the patient, but also place strains on the ambulance attendant.

A still further disadvantage of existing ambulance cots is that although they may be designed to suit a particular height of ambulance loading platform, they usually cannot readily adapt to the gradual changes in height which commonly occur over time as the ambulance ages. This will result in increasing strain being placed on the ambulance attendant as he is forced to take the weight of the cot as it is being loaded or unloaded.

OBJECT OF THE INVENTION

It is therefore an object of the present invention to provide patient transporting equipment which obviates or at least minimises the aforementioned disadvantages.

SUMMARY OF THE INVENTION

One aspect of the present invention provides an undercarriage comprising a support structure fitted to a height adjustable framework consisting of first and second pairs of collapsible legs, and an actuating means for adjusting the height of the support structure, wherein the actuating means comprises tie means connected to the first and second pairs of collapsible legs and to the support structure, which tie means is retractable or extendable so as to extend or collapse the first and second pairs of legs to thereby adjust the height of the support structure.

The design of the undercarriage is such that it can be adjusted to a continuum of heights between the fully collapsed and fully extended position of the first and second pairs of collapsible legs. Further, the maximum height to which the support structure can be raised can readily be controlled by appropriate stop means. Such stop means can be suitably interposed between the first or second pairs of adjustable legs and the support structure, and can be manually relocatable between an infinite number of fixed positions to thereby control the amount by which the tie means is retracted.

The tie means can comprise one or more ties, and preferably consists of first and second flexible ties respectively connected to the first and second pairs of collapsible legs. Suitably, the first and second flexible ties are connected to the support structure through the intermediary of first and second spools onto which the first and second flexible ties are respectively retractable. Connection of the ties to the collapsible legs is preferably effected through the intermediary of first and second cross-bars, The spools are suitably maintained under spring tension so that the associated flexible tie is biased to wind onto that spool. Each spool can have an associated ratchet mechanism to enable its associated flexible tie to be unwound from its spool when the associated ratchet mechanism is disengaged so that the support structure can be lowered. Such a ratchet mechanism may not be too dissimilar to that found in conventional motor vehicle seat belt retractor mechanisms.

When the undercarriage is designed for use with stretchers, the support structure will have a generally rectangular configuration. Such a structure will preferably comprise two longitudinally extending, substantially parallel spaced beams interconnected by connector members. The first and second pairs of collapsible legs will suitably be angled downwardly from intermediate regions of each of the beams. The first pair of legs are preferably interconnected for movement in unison with one another and can be pivotally joined to fixed points on the respective beams. The second pair of legs can likewise be interconnected and pivotally joined to a first cross-bar extending between the beams, which cross-bar is slidable with respect to two shafts one each of which extends adjacent and parallel to one of each said beams, there being provided a pair of first linkages which each pivotally connect an intermediate portion of each one of said first pair of legs to a second cross-bar slidable with respect to the shafts and a pair of second linkages which pivotally connect an intermediate portion of each one of the second pair of legs to a fixed point on the respective beams.

The first and second pairs of legs are fitted with ground wheels at their extremities when used to transport patients.

Raising and lowering of the undercarriage can be effected manually under the control of hand operable controls located proximate to the upper surface of the support structure at one end thereof. In order to effect lowering, the hand controls are activated while the support structure is fractionally raised. This enables the ratchet mechanism to release the tie means so that the tie means can be extended and thereby collapse the first and second pairs of legs.

The support structure can be suitably fitted with two pairs of wheels, castors or rollers, depending from the undersurface thereof—one pair at one end and another pair in a mid-sectional region of the structure. The second pair of legs is suitably formed in two sections to enable folding when the arrangement is being loaded onto a raised platform such as an ambulance. The location of the mid-sectional wheels on the support structure and the relative positioning of an extended lower leg portion of each of the second pair of legs past its pivot point with the upper leg portion, is designed to ensure that the complete weight on the support structure is always borne by either the ground wheels or the wheels on the support structure, and not by the person loading or unloading the support structure in, for instance, an ambulance.

This is a very important consequence of the invention as no existing arrangement enables this to be achieved. It will be appreciated from the foregoing that such effort-free loading is a result of the fact that the height of the support structure can be instantaneously adjusted to the loading height of the ambulance floor by the multi-height adjustment feature. In practice, the height of the leading pair of ground wheels is adjusted in height so that their bottom surfaces are slightly below the loading floor of the ambulance. Thus, as the undercarriage is pushed into the ambulance, the leading wheels rise onto the loading surface and take the weight off the second (i.e. leading) pair of collapsible legs, enabling the second pair of legs to collapse (i.e. pivot) rearwardly toward the attendant. Further movement of the undercarriage into the ambulance brings the mid-sectional wheels on the support structure into contact with the ambulance floor to enable full support for the undercarriage. Subsequent collapsing of the first pair of collapsible legs is effected as the undercarriage is moved fully into the ambulance.

Unloading of the undercarriage occurs in the exact reverse steps with no concomitant strain being placed on the attendant's back as the undercarriage is being moved.

The undercarriage is suitably constructed primarily from lightweight material such as aluminium magnesium alloy, or the like, with the optional use of high density metals such as cast-iron or stainless steel for parts subject to high load or stress. Plastic coatings or sheaths may be applied to regions of the undercarriage which come into contact with the ambulance and the wheels can have rubber or plastics treads, with plastics or metallic bearings.

The support structure will be dimensioned to suit the nature of the object to be transported and since this is generally a patient, it will be of sufficient length and width to accommodate conventional sized stretchers. Such stretchers may be fitted to the rectangular support structure by known arrangements such as by a pair of horizontally opening slide-in housings on one end of each beam and a pair of upwardly opening housings on the other end of each beam which include a U-shaped clamp. These housings are such that a bar in each end of the stretcher is retained therein when the U-shaped clamps are closed about one of the bars.

The wheeled height adjustable framework generally enables the support structure to be set at practically any height from approximately twenty centimetres above the ground level to a height above that of the waist of an average height adult. The legs can be fabricated from tubular, box-profile or rectangular section metal with cast metal end inserts to provide high strength points for pivoting or connecting purposes. Each leg is preferably a single uniformly rigid member however each of the second pair of legs most preferably comprises two sections which are interconnected on a shaft which is common to the second pair of linkages and about which the two sections and the linkages can pivot. The two sections are normally retained in a relative rigid extending orientation by means of a pin connecting the two sections together. However, upon release of the pin from an engaging arrangement, the lower portions of the second pair of legs can pivot the wheeled extremities towards the first pair of legs, when the adjustable framework is at an appropriate height, to enable loading of the undercarriage into an ambulance. Such pivoting is generally effected by the lower portions of the second pair of legs being pushed against the bumper bar on the rear of the ambulance. As the undercarriage is thus loaded, the first pair of legs is simultaneously folded towards the support structure by operation of the hand controls and the framework rolls onto the wheels fitted directly to the beams.

Suitably, connecting rods join the separate pairs of legs at their wheeled extremities and another rod is positioned to extend between the pivot points of the first pair of legs and the first linkage.

The shafts on which the first and second cross-bars are slidable to accommodate the height adjustment capacity of the undercarriage, preferably extend from an end of each beam to a position past the mid-point of each beam. The ends of the beams from which they extend are those ends under which the second pair of legs extend. The shafts are suitably tubular in configuration and are located on the inner face of each beam.

The stop means previously referred to can be slidable along the shafts to limit the extent to which the first and/or second cross-bars are movable, thereby limiting the height of the support surface. Such stops are set to enable a stretcher to be loaded into an ambulance at the correct height and do not have to be reset unless a different loading height is required.

The tie means can comprise rigid or flexible means, but is preferably flexible to enable winding onto a spool or like arrangement. It can consist of rods, levers, chains, belts, ropes or the like but is preferably belts such as closely woven fabric belts having high strength and low stretchability. The belts are tightly wound on spools under spring tension and are retained under tension by virtue of locking mechanism which preferably consists of a pawl and ratchet arrangement fitted to the end of each spool. The pawl is normally spring-based against the ratchet to prevent rotation of the ratchet and the attached spool. Release of the pawl can only be effected by operation of the hand control which may consist of a bicycle-type handle with brake fitting which acts on a cable release to the pawl, and the simultaneous release of weight on the pawl by the operator slightly uplifting the end of the support structure.

Preferred embodiments of the invention will now be described with reference to the accompanying drawings.

BRIEF DESCRIPTION OF THE DRAWINGS

FIG. 3 is a side-on view of the undercarriage of FIG. 1 showing the movement of the legs upon collapsing;

FIG. 4 is a perspective view of the undercarriage of FIG. 1 in a fully collapsed configuration;

DETAILED DESCRIPTION OF PREFERRED EMBODIMENTS

Figure 1:
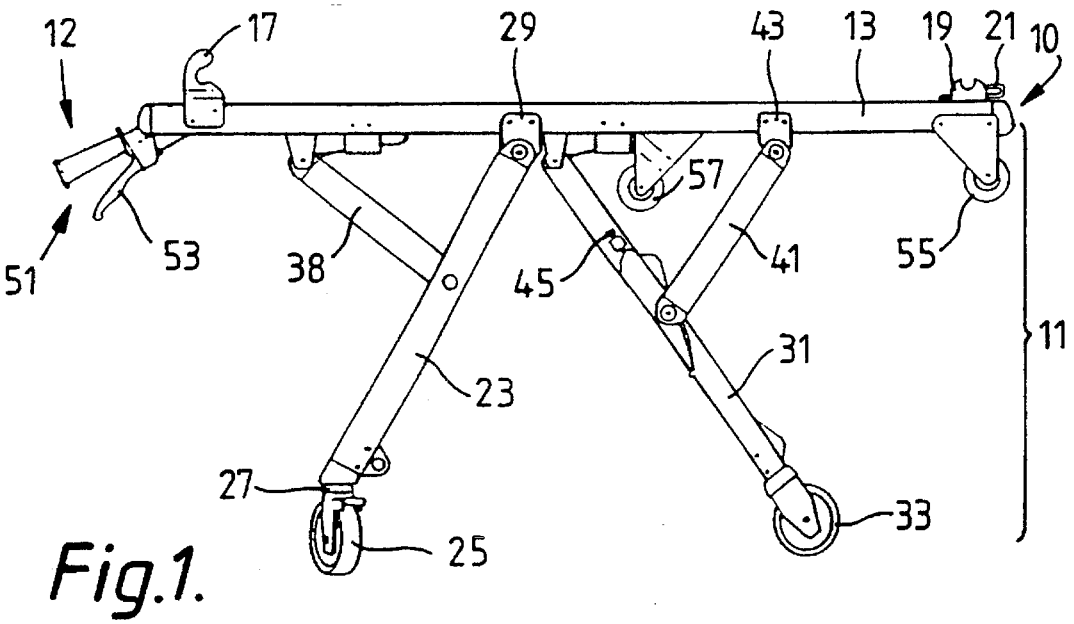
FIG. 1 is a side-on view of an undercarriage in fully extended configuration in accordance with the present invention.

In all the drawings like reference numerals refer to like parts.

Figure 2:
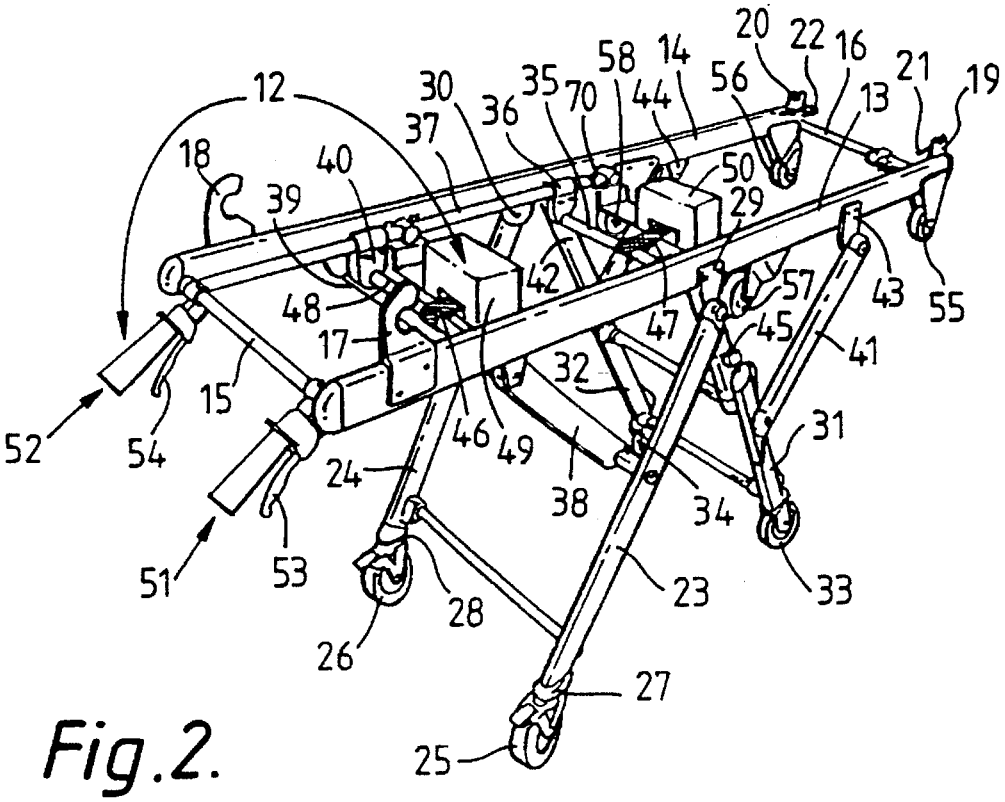
FIG. 2 is a perspective view of the undercarriage of FIG. 1.

Referring firstly to FIGS. 1, 2 and 4, the undercarriage comprises a rectangular support structure 10, a wheeled height adjustable framework 11, and an actuating arrangement 12.

The rectangular support structure 10 consists of two longitudinally extending beams 13, 14 rigidly interconnected by the rods 15, 16. Horizontally opening housings 17, 18 are provided on one end of the beams to accommodate a first restraining bar of a stretcher (not shown) and upwardly opening housings 19, 20 are provided on the other end of the beams to accommodate a second restraining bar on the other end of the stretcher. The upwardly opening housings have spring-biased clips 21, 22 to lock around the second restraining bar of the stretcher.

Two pairs of support wheels 55, 56, and 57, 58 are provided for supporting the structure when it is loaded into an ambulance as hereinafter described.

The wheeled height adjustable framework 11 consists of two pairs of legs. A first pair of legs 23, 24 is fitted with ground wheels 25, 26 on universal bearings 27, 28 to permit swivelling in a horizontal plane. The first pair of legs are pivotally connected to flanges 29, 30 fixed to the beams 13, 14. A second pair of legs 31, 32 carrying ground wheels 33, 34 at their extremities, are interconnected and pivotally joined to a first cross-bar 35. The first cross-bar is retained by two housings, one of which can be seen in FIG. 2 and is referenced 36. The two housings are slidable along shafts carried by the beams. Shaft 37 can be seen in FIG. 2.

The framework also includes a pair of first linkages 38, 39 which pivotally connect the first pair of legs 23, 24 to housings (housing 40 illustrated) also slidable on the shafts and interconnected by a second bar 48; and a second pair of linkages 41, 42 which pivotally connect the second pair of legs 31, 32 to flanges 43, 44 on the respective beams.

The second pair of legs 31, 32 comprise upper and lower portions to enable folding, as illustrated in FIG. 3 when the lower portions are contacted with a rear portion of the ambulance and the fixing pin 45 has been removed from the lower leg. In this regard, the relative positioning of wheels 57, 58 with respect to the extended portions of the lower legs, e.g. see item 31*a* in FIG. 3, is essential to ensure that all weight is transferred between the wheels and ambulance or ground and not to the operator when loading or unloading the undercarriage.

The actuating arrangement comprises a first belt 46 and a second belt 47 respectively connected to the first and second cross-bars 35, 48 and extending into housings 49, 50. The extension of these belts is controlled by handles 51, 52 having cable release brakes 53, 54 connected to the housings 49, 50. For further explanation of the mechanism within these housings, reference is now made to FIGS. 7 and 8.

Figure 7:
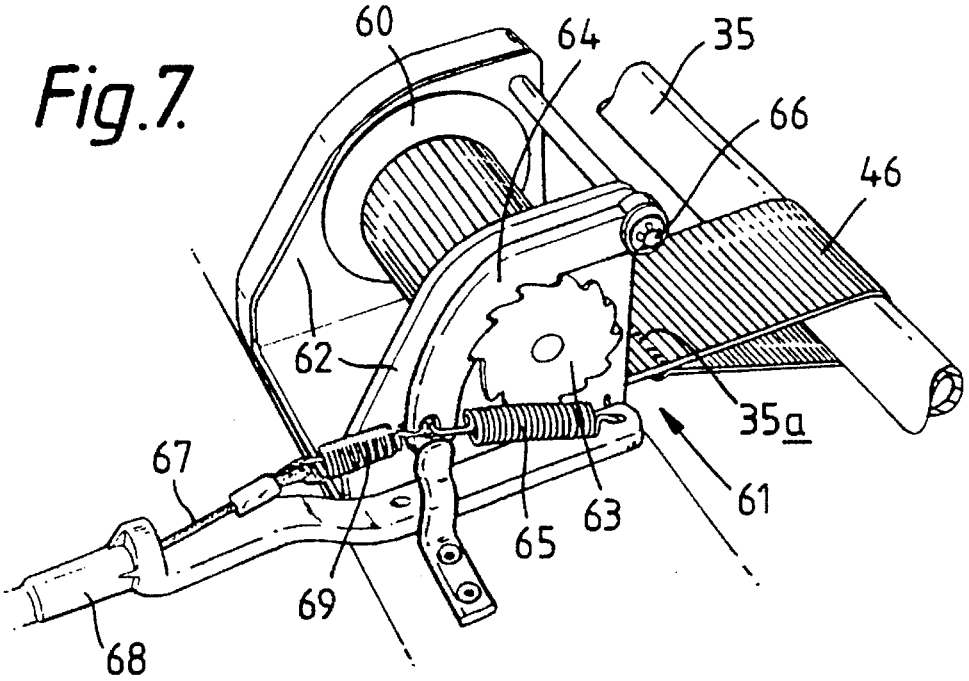
FIG. 7 is a close-up perspective view of part of a tie spool mechanism for the undercarriage of FIG. 1 in a locked mode.
Figure 8:
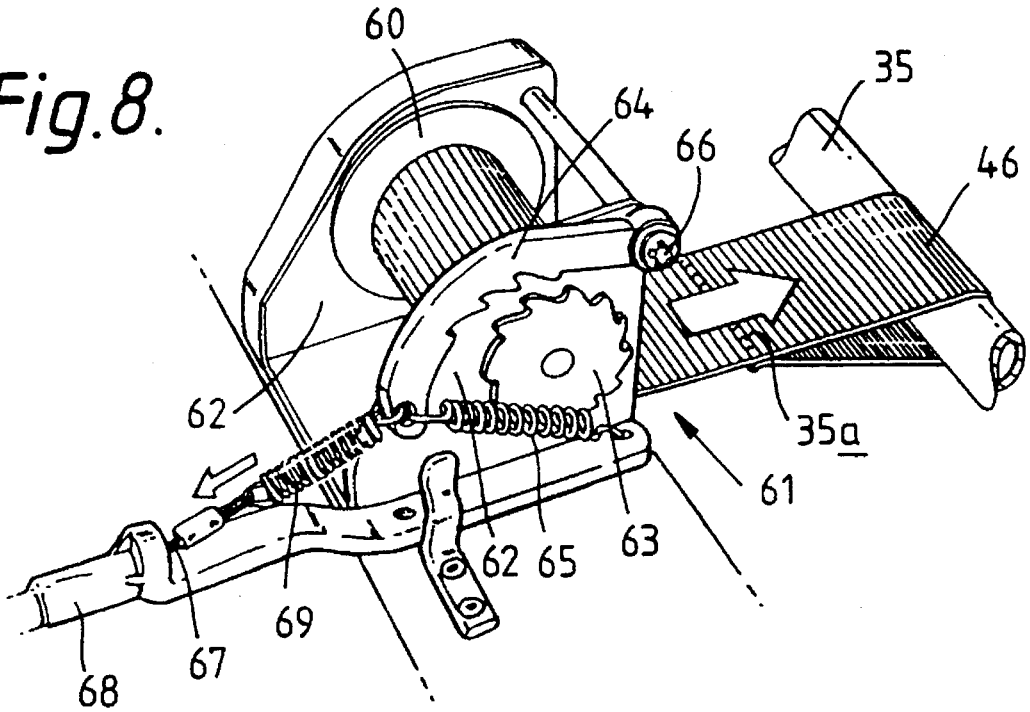
FIG. 8 is a close-up perspective view of the tie spool mechanism of FIG. 7 in an unlocked mode.

FIGS. 7 and 8 show the housing cover of housing 50 removed. The arrangement in housing 49 is similar and will not therefore be described. As can be seen, belt 46 is connected to cross-bar 35 by looping around the cross-bar and joining the tape to itself by stitching 35*a*. Belt 46 is wound onto a spool, an end piece 60 of which can be seen. The spool is under spring-tension in a known manner, e.g. as in a vehicle seat belt retractor mechanism, to maintain the belt tightly wound onto the spool. Movement of the cross-bar 35 away from the spool which would result in collapsing of the height adjustable framework, is normally prevented by virtue of a ratchet mechanism 61 fitted to one side of a vertical spool support 62. The ratchet mechanism comprises a saw-toothed cog wheel 63 journalled to the axis of the spool 60, which is prevented from rotation by a pawl member 64 mating with the saw teeth as shown in FIG. 7. The pawl member 64 is maintained in mating contact with the saw-toothed cog wheel 63 by spring 65 which pivots the pawl downwardly about pivot point 66. In order to release the pawl member from engagement with the cog wheel, a release cable 67 must be retracted through housing 68 so that tension is applied through spring 69 to the end of the pawl, and there must be simultaneous slight upward urging movement placed on the overbalanced pawl 64 to move it fractionally upwardly to clear the teeth of the cog wheel. This upward movement can be effected by normally urging the support structure upwardly with the slightest force. Upon release of the pawl 64 from the cog wheel 63, the belt 46 is extended from its spool due to the weight of the support structure having a tendency to collapse and to thereby slide the draw-bar 35 away from the spool, in the direction as shown by the large arrow A.

Figure 5:
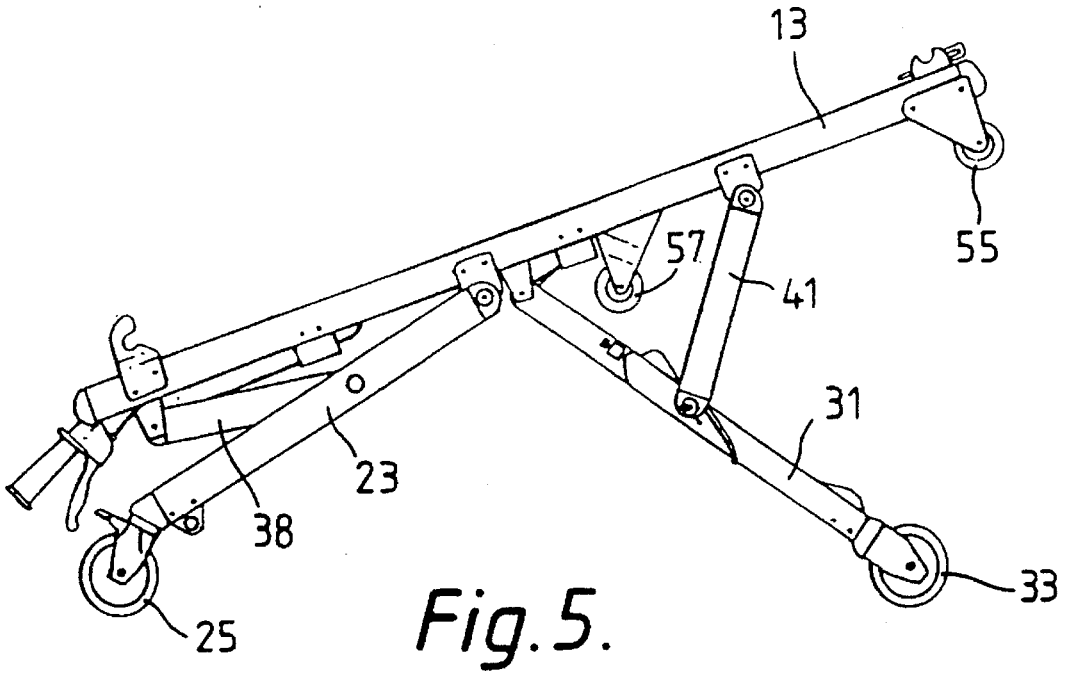
FIG. 5 is a side-on view of the undercarriage of FIG. 1 with one end elevated.
Figure 6:
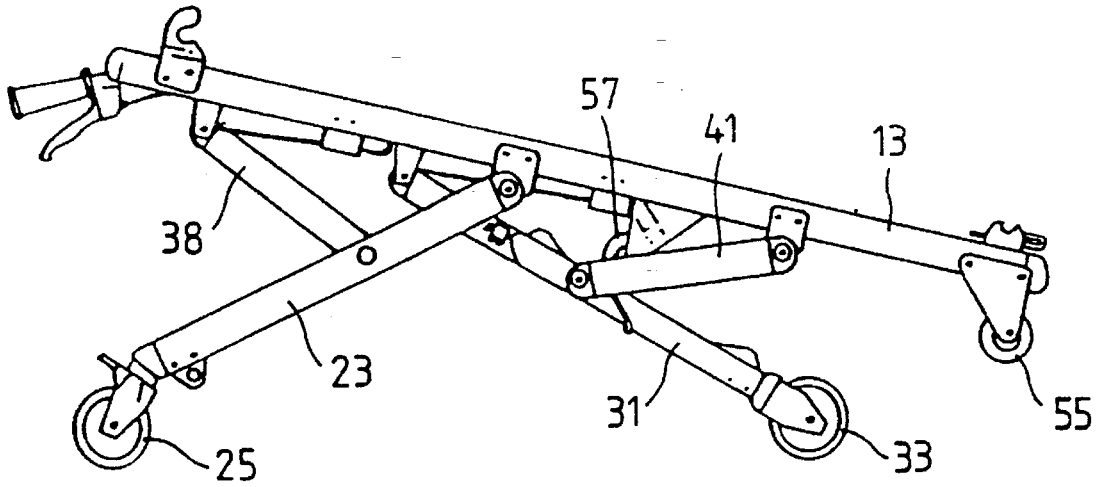
FIG. 6 is a side-on view of the undercarriage of FIG. 1 with the other end elevated.

FIGS. 5 and 6 show the configuration resulting when only one end of the support structure is lowered and FIG. 4 shows the completely collapsed configuration. This collapsed configuration is adopted when the undercarriage is collapsed straight onto the ground and is not the configuration when the undercarriage is collapsed into an ambulance as in that configuration the legs 41 fold forwardly.

The maximum height to which the support surface can be raised, is regulated by two slidable stops on the shafts. One of these stops can be seen in FIG. 2 and is referenced item 70. Each stop comprises a tubular sleeve having a knurled screw-threaded pin projecting through its side to enable the sleeve to be manually secured at any position on the shaft. By securing the sleeve to the shaft, the distance which the cross-bar 36 can move along the shaft is set, thereby setting the height of the collapsible legs and the support surface. Such a setting is important to ensure that the correct height of the support surface is always reached when the stretcher is raised for loading into an ambulance or onto some other raised surface.

Figure 9:
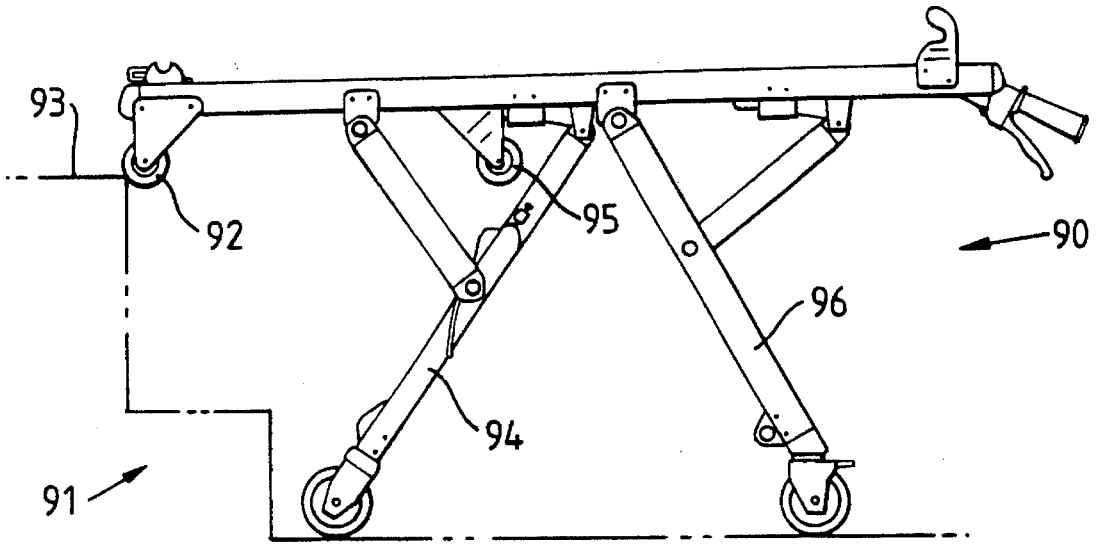
FIGS. 9, 10, 11 and 12 are side-on views of a stretcher undercarriage in various stages as it is being loaded into an ambulance.
Figure 10:
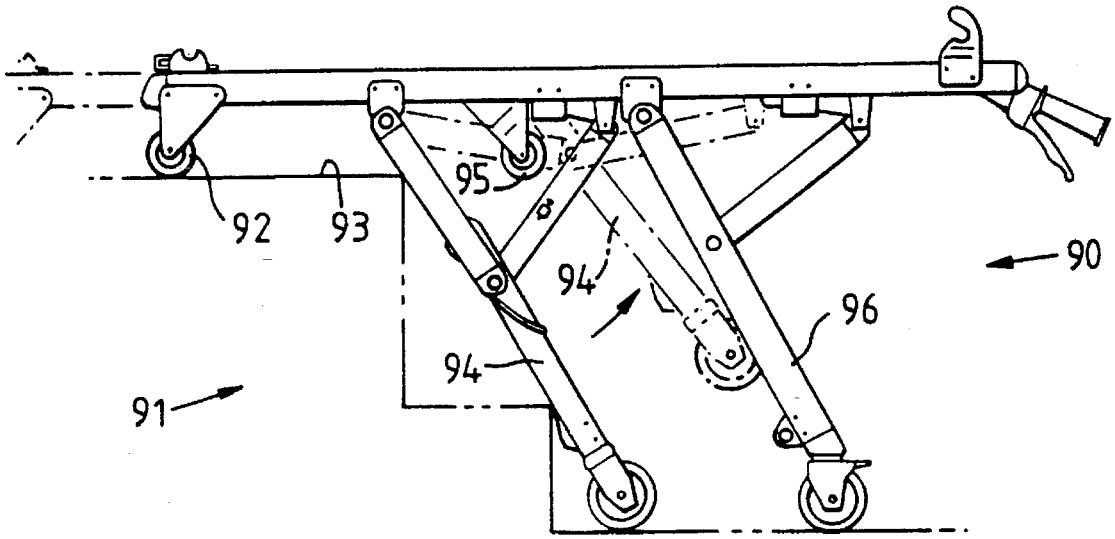
Figure 11:
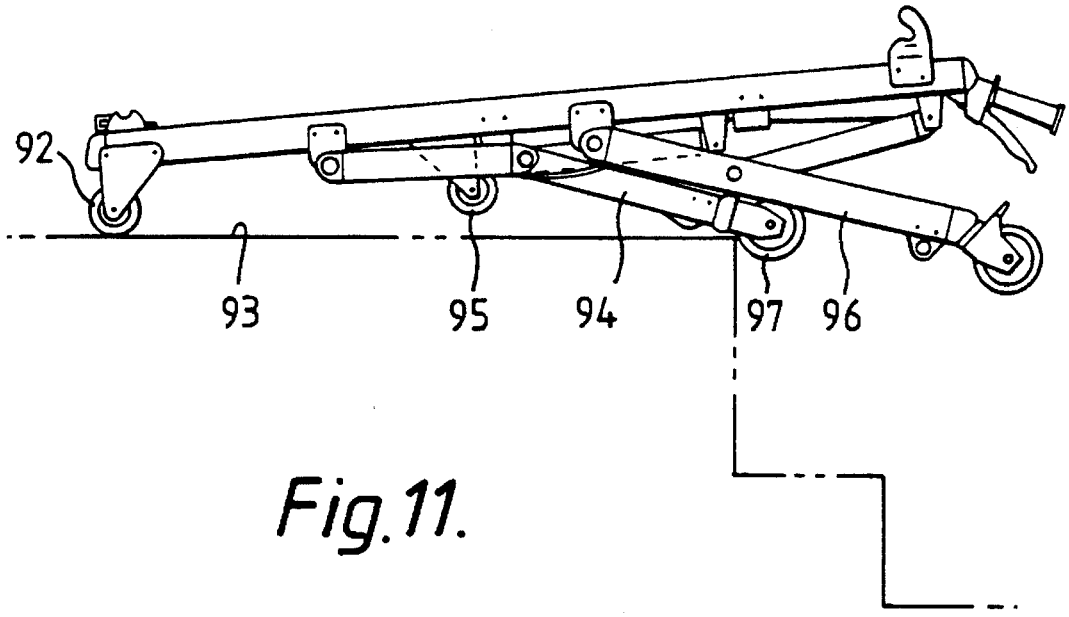
Figure 12:
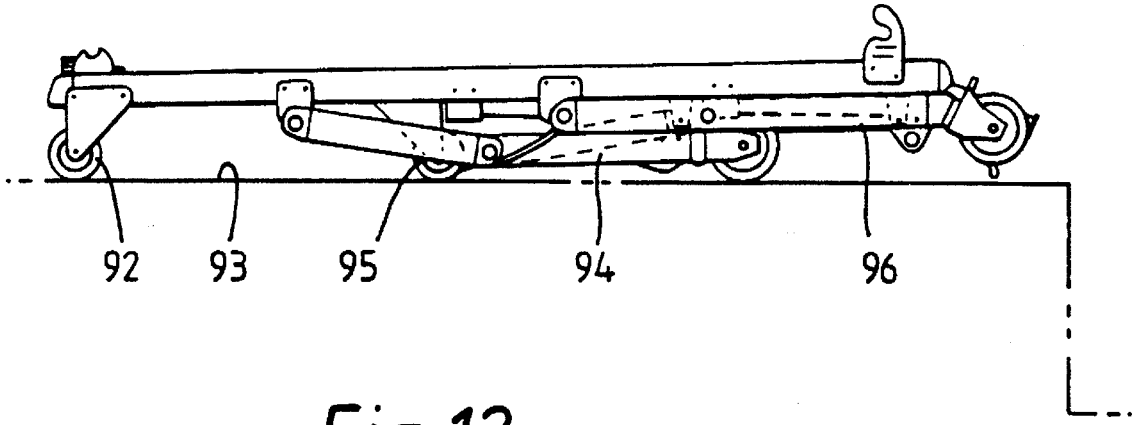

FIGS. 9, 10, 11 and 12 show a stretcher undercarriage being loaded into an ambulance. FIG. 9 shows the stretcher undercarriage 90 as it approaches the rear entrance of the ambulance 91. The point to note is the relative height of the stretcher wheel 92 to the surface 93 of the loading bay of the ambulance. The base of the stretcher wheel 92 has been adjusted by the height adjusting feature to be fractionally lower than the surface 93 so that as the stretcher undercarriage is moved forward, the stretcher wheel 92 rises up onto the surface 93, thereby enabling the second pair of legs 94 of the undercarriage to pivot rearwardly as illustrated in FIG. 10. Further movement of the stretcher undercarriage brings the leg wheels 97 onto the surface 93 of the loading bay, as shown in FIG. 11, and then intermediate wheels 95, thereby transferring the entire weight of the stretcher undercarriage to the ambulance, while the first pair of legs 96 begin to fold up under the support surface. The fully loaded undercarriage is shown in FIG. 12.

During the loading operation no effort is needed by the attendant to lift the stretcher undercarriage into the loading bay.

During unloading, the reverse of the above steps occur similarly with no effort being required by the attendant during this process either.

It will be appreciated from the foregoing that the invention enables effortless loading and unloading of cots into and from ambulances without the inherent strains on the attendant which are associated with existing cots. The invention is furthermore such that multi height loading or unloading can be achieved without the need for time consuming adjustments of associated pins and/or levers as has been the case in the past.

Whilst the above has been given by way of illustrative example of the invention, many modifications and variations may be made thereto by persons skilled in the art without departing from the broad scope and ambit of the invention as herein set forth in the following claims.

The claims defining the invention are as follows:

1. An undercarriage comprising a support structure fitted to a height adjustable framework consisting of first and second pairs of collapsible legs, and an actuating means for adjusting the height of the support structure, wherein the actuating means comprises first and second flexible ties respectively connected to the first and second pairs of collapsible legs and to the support structure through the intermediary of first and second spools onto which said first and second flexible ties are respectively retractable, which first and second flexible ties are retractable or extendable so as to extend or collapse the first and second pairs of legs to thereby adjust the height of the support structure, and wherein each said spool is under spring tension so that the associated flexible tie is biased to wind onto that spool, each said spool having an associated ratchet mechanism to enable its associated flexible tie to be unwound from its spool when the associated ratchet mechanism is disengaged so that the support structure can be lowered.

2. An undercarriage as claimed in claim 1, wherein the height of the support structure is infinitely adjustable between the fully collapsed and fully extended position of the first and second pairs of collapsible legs.

3. An undercarriage as claimed in claim 2, wherein the maximum height to which the support structure is raised is adjustable by stop means which control the amount by which the tie means is retracted.

4. An undercarriage as claimed in claim 1, wherein said first and second flexible ties are respectively connected to the first and second pairs of collapsible legs through the intermediary of first and second cross-bars.

5. An undercarriage as claimed in claim 1, wherein the first and second flexible ties are belts.

6. An undercarriage as claimed in claim 3, wherein said stop means is interposed between the first or second pairs of collapsible legs and is manually relocatable between an infinite number of fixed positions to thereby control the amount by which the tie means is retracted.

7. An undercarriage as claimed in claim 1, in which the support structure is adapted to carry a patient stretcher.

8. An undercarriage comprising a support structure fitted to a height adjustable framework consisting of first and second pairs of collapsible legs, and an actuating means for adjusting the height of the support structure, wherein the actuating means comprises first and second flexible ties respectively connected to the first and second pairs of collapsible legs and to the support structure, which ties are retractable or extendable so as to extend or collapse the first and second pairs of legs to thereby adjust the height of the support structure; wherein said support structure comprises two substantially parallel spaced beams interconnected by connector members, and wherein said first and second pairs of collapsible legs are angled downwardly from intermediate regions of each of said beams, said first pair of legs being interconnected and pivotally joined to fixed points on said respective beams and said second pair of legs being interconnected and pivotally joined to a first cross-bar extending between said beams, which first cross-bar is slidable with respect to two shafts one each of which extends adjacent and parallel to one of each said beams, there being provided a pair of first linkages which each pivotally connect an intermediate portion of each one of said first pair of legs to a second cross-bar slidable with respect to said shafts and a pair of second linkages which pivotally connect an intermediate portion of each one of said second pair of legs to a fixed point on the respective beams.

9. An undercarriage as claimed in claim 8, wherein said first and second pairs of legs are fitted with ground wheels at their extremities and the support structure is adapted to carry a stretcher.

* * * * *

UNITED STATES PATENT AND TRADEMARK OFFICE

CERTIFICATE OF CORRECTION

PATENT NO. : 5,509,159
DATED : April 23, 1996
INVENTOR(S) : Robert L. Du-Bois

It is certified that error appears in the above-indentified patent and that said Letters Patent is hereby corrected as shown below:

On cover page, item [21] Application No. should read --295,813--.

Signed and Sealed this

Seventeenth Day of September, 1996

*Attest:*

BRUCE LEHMAN

*Attesting Officer*

*Commissioner of Patents and Trademarks*